US008968111B2

(12) United States Patent
Malak

(10) Patent No.: US 8,968,111 B2
(45) Date of Patent: Mar. 3, 2015

(54) CUE BALL AIMING AND BILLIARD TRAINING DEVICE

(76) Inventor: Stephen P. Malak, Manlius, NY (US)

( * ) Notice: Subject to any disclaimer, the term of this patent is extended or adjusted under 35 U.S.C. 154(b) by 788 days.

(21) Appl. No.: 12/687,303

(22) Filed: Jan. 14, 2010

(65) Prior Publication Data

US 2010/0120547 A1 May 13, 2010

Related U.S. Application Data

(63) Continuation of application No. 11/633,016, filed on Dec. 4, 2006, now Pat. No. 7,658,680.

(51) Int. Cl.
*A63D 15/00* (2006.01)

(52) U.S. Cl.
CPC ..... *A63D 15/006* (2013.01)
USPC ..... 473/2

(58) Field of Classification Search
CPC ..... A63D 15/00; A63D 15/006
USPC ..... 473/2, 1, 5, 17, 44, 52, 220, 219
See application file for complete search history.

(56) References Cited

U.S. PATENT DOCUMENTS

| | | | | | |
|---|---|---|---|---|---|
| 690,617 | A * | 1/1902 | Ruhland | 473/42 |
| 1,783,211 | A * | 12/1930 | Baldwin | 473/257 |
| 3,899,179 | A * | 8/1975 | Vlach | 473/218 |
| 6,769,992 | B1 * | 8/2004 | Domulevicz et al. | 473/2 |
| 6,860,816 | B2 * | 3/2005 | Bond et al. | 473/2 |
| 6,866,590 | B2 * | 3/2005 | Tucker | 473/2 |
| 7,118,486 | B2 * | 10/2006 | Evers | 473/2 |
| 7,147,566 | B2 * | 12/2006 | Keating | 473/2 |
| 2005/0009613 | A1 * | 1/2005 | Davis | 473/2 |
| 2005/0119058 | A1 * | 6/2005 | Walton | 473/2 |
| 2005/0209013 | A1 * | 9/2005 | Davis et al. | 473/2 |
| 2006/0128488 | A1 * | 6/2006 | Pappas | 473/2 |

FOREIGN PATENT DOCUMENTS

| | | | | | |
|---|---|---|---|---|---|
| FR | 000443563 | A | * | 9/1912 | A63D 15/0006 |
| FR | 000563496 | A | * | 12/1923 | A63D 15/0006 |
| FR | 000771260 | A | * | 4/1934 | A63D 15/0006 |
| FR | 000771144 | A | * | 10/1934 | A63D 15/0006 |
| FR | 2565119 | A1 | * | 12/1985 | A63D 15/0006 |
| GB | 191003572 | A | * | 0/1910 | A63D 15/0006 |
| GB | 191114062 | A | * | 0/1912 | A63D 15/0006 |
| GB | 191209527 | A | * | 0/1913 | A63D 15/0006 |
| GB | 191226076 | A | * | 0/1913 | A63D 15/0006 |
| GB | 191418135 | A | * | 0/1914 | A63D 15/0006 |
| GB | 2194161 | A | * | 3/1988 | |
| GB | 2224945 | A | * | 5/1990 | |

* cited by examiner

*Primary Examiner* — Mitra Aryanpour
(74) *Attorney, Agent, or Firm* — Schmeiser, Olsen & Watts, LLP

(57) ABSTRACT

This invention relates to the field of playing billiards and in particular to a cue ball aiming or training device for learning to aim a cue ball to an object ball to drive the object ball in a desired direction. The aiming device provides an indication of the true point of aim for directing a cue ball to an object ball, to drive the object ball in a desired direction. In use, the aiming device is positioned on top of the object ball and has a direction indicator to point to the desired intended direction of the object ball and a strike point indicator to identify the true point of aim for the cue ball.

51 Claims, 7 Drawing Sheets

CUE BALL AIMING AND BILLIARD TRAINING DEVICE

CROSS-REFERENCE TO RELATED APPLICATIONS

This application is a continuation of and claims priority from U.S. patent application Ser. No. 11/633,016 filed on Dec. 4, 2006 and entitled "CUE BALL AIMING AND BILLIARD TRAINING DEVICE."

FIELD OF THE INVENTION

This invention relates generally to the field of playing billiards or pool. In particular it is related to a training device, a cue ball aiming or a spotter device for learning to aim a cue ball to an object ball to drive the object ball in a desired direction. The aiming device provides an indication of the true point of aim for directing a cue ball to an object ball, to drive the object ball in a desired direction. In use, the aiming device is positioned on top of the object ball, with a direction indicator to point to the desired intended direction of the object ball and a strike point indicator to locate the true point of aim for the cue ball.

BACKGROUND OF THE INVENTION

The primary object of pocket billiards is to stroke cue ball to an object ball such that the object ball is driven in a desired direction. The object ball is driven either, to a ball pocket, to another billiard ball, or to a particular point on a selected rail on the billiard table.

A player must become good at eyeing the aiming point near the object ball in order to drive it in a desired direction. It is necessary for the player not only to stroke the cue ball properly but to also learn to visualize the aiming point in free space near the object ball. This aiming point, which can also be referred to as a strike point, a sight point, a cue ball strike point, a desired point of contact of aim, or true point of aim is not a spot on the object ball. The true point of aim is an aim or strike point spaced a distance equal to one-half the diameter of the object ball from the-surface of the object ball and one-half the diameter of the object ball from the surface of the billiard table. Therefore, the correct aim point is an imaginary point in free space closely associated with the object ball. The cue ball aiming device of the present invention helps develop the skill in visualizing this strike point or aim point in a contact zone near the object ball. If a cue ball is shot so that its center is directed at that contact zone in free space near the object ball, once the cue ball strikes the object ball, the object ball will move in the desired intended line of travel. The solution is to teach a player how to visualize this strike or aim point near the object ball.

A primary limitation of the prior art devices that such devices are cumbersome to set up, they are in the line of sight of the cue ball or object ball, they are complex to understand, or they can interfere with the movement of the object ball after the object ball is struck by the cue ball. Particular devices disclosing such teaching aids are disclosed for example in U.S. Pat. Nos. 4,268,033; 3,411,779; 3,947,026; 3,711,091; 3,410,555; 3,843,120; 6,527,647; 4,178,694; 4,151,990; and 4,337,943. U.S. Pat. No. 4,268,033 shows a cue ball aiming device which is placed on the surface of the billiard table and over the object ball. This device, however is cumbersome to use, restricts the player's sight of the object ball, and can interfere with the travel of the cue ball to the object ball or interfere with the travel of the object ball after it is struck by the cue hall. U.S. Pat. No. 3,411,779 shows a training device which is also positioned over the object ball. However, once this device is moved away from the object ball the player still faces having to visualize the strike point in free space. The remaining patents' referenced show devices that in one way or another rest on the billiard table or near the object ball, and all have the problem of either restricting in one way or another the travel of the cue ball to the object ball or after removal of the device from the table the player is faced with the problem of having to re-visualize the strike point.

SUMMARY OF THE INVENTION

The novelty of the invention is the providing and positioning of a cue ball aiming device on the object ball itself. The aiming device remains on the object ball to clearly define the exact strike point in free space for the player to visualize, and it does not interfere with the travel of the cue ball to the object ball itself. The aiming device rests on the object ball until the object ball is struck by the cue ball, at which time the aiming device is easily flipped off or knocked off the object ball by the impact of the cue ball with the object ball. The aiming device has three functional sections, a support section that in one form be a support structure that is positioned to rest on top of the object ball, a strike point section that in one form can be a strike point indicator defining the strike point in free space for the cue ball, and a direction section which in one form can be a direction indicator which is oriented by the player in the direction to which the object ball is desired to be driven. No component of the aiming device ever rests on the surface of the billiard table and accordingly never obstructs the players' view or movement of the billiard balls. The direction indicator operates with the strike point indicator such that when the direction indicator is oriented by the player to the desired direction to which the object ball is to be driven, the strike point indicator is positioned to define the exact aim point. When the cue ball is aimed and stroked to the strike point, the cue ball will hit the object ball in the desired direction. The aiming device can be made very light so that upon the object ball being hit by the cue ball, the aiming device will be safely flicked off the object ball as if it was not there. The aiming device does not interfere with the travel of the cue ball to the object ball and being positioned on top of the object ball away from the cue ball, will not damage the surface of the billiard table.

It is accordingly objects of the invention to provide a cue ball aiming device that is simple to use, is light weight, is self-centering and stable on the object ball, is easy to place on the object ball, is reuseable, is easy to orient the device to the desired direction of travel for the object ball, does not interfere with the travel of the cue ball in striking the object ball, does not interfere with the sighting by the player of the strike point, provides a clear and continuous indication of the strike point to the player until the object ball is struck, will not damage the billiard table cover since it does not rest on the billiard table, is simple in construction, and has a low manufacturing cost.

Another object of the invention is to provide an improved training device for use in indicating the true and correct strike point or 4 aim point for the cue ball to be aimed at in order to strike the object ball in the intended direction.

It is another object of the invention to provide a player with an object ball spotter for aiming a cue ball to an object ball to a desired direction on a billiard table, comprising, a support mounted on the object ball, a pointer or strike point indicator mounted on the support at a first position, the strike point indicator defining an aiming or strike point for the cue ball, and a direction indicator on the support at a second position indicating the desired direction of the object ball, whereby upon the player orienting the direction indicator to the desired direction the strike point indicator defines the location for the aim point for the cue ball.

A further object of the invention is to provide for a cue ball spotter for an object ball in a billiard game comprising, a base structure mounted on the object ball, a sight point indicator on the base structure at a first position, the sight point indicator defining a desired cue ball strike point, and a direction indicator located on the base structure at a second position for indicating the desired direction of the object ball and for positioning the sight point indicator to the desired cue ball strike point.

A further object of the invention is to provide a cue ball aiming device for aiming a cue ball with respect to an object ball comprising, a support mounted on the object ball, a cue ball strike point structure on the support at a first position, and indicia located on the support at a second position capable of being oriented by a player to a desired direction for the object ball to travel and for positioning the cue ball strike point with respect to the object ball.

A still further object of the invention is to provide a device for teaching a player aiming of a cue ball to an object ball in a billiard game comprising, a support mounted on the object ball, a sight point indicator on the support at a first position, the sight point indicator defining a desired cue ball strike point, and a direction indicator located on the support at a second position for indicating the desired direction of the object ball and for positioning the sight point indicator to the desired cue ball strike point.

A further object of the invention is to provide a player a point of aim indicator for defining a strike point for a cue ball at an object ball on a billiard table comprising, support means mounted on the top surface of the object ball, first means defining a strike point with respect to the object ball, the first means mounted on the support at a first position, and second means for indicating the desired direction of travel for the object ball and positioning the first means with respect to the object ball, the second means mounted on the support at a second position, whereby upon striking the cue ball to the strike point the object ball will be pushed to travel in the desired direction of travel on the billiard table.

A further object of the invention is to provide a billiard ball training device for defining a desired contact point of a cue ball with the billiard ball comprising, a support mounted on the billiard ball, a contact point indicator on the support indicating the desired aiming point of the cue ball with the billiard ball, and a direction indicator on the support for indicating a desired direction for the billiard ball, the direction indicator positioning the contact point indicator at the desired aiming point.

Another object of the invention is to provide a method of defining a strike point for a cue ball to strike an object ball in a desired direction in a billiard game comprising the steps of, providing a support section on the object ball, providing a sight point section operating with the support section to define the strike point, and providing a direction indicator section operating with the support section to define the desired direction of the object ball and to position the sight point to the strike point, whereby striking the cue ball to the strike point will drive the object ball in the desired direction on the billiard table.

Other features and advantages of the invention will be apparent from the following description taken in conjunction with the drawings.

DETAILED DESCRIPTION OF THE PREFERRED EMBODIMENT

Figure 1:
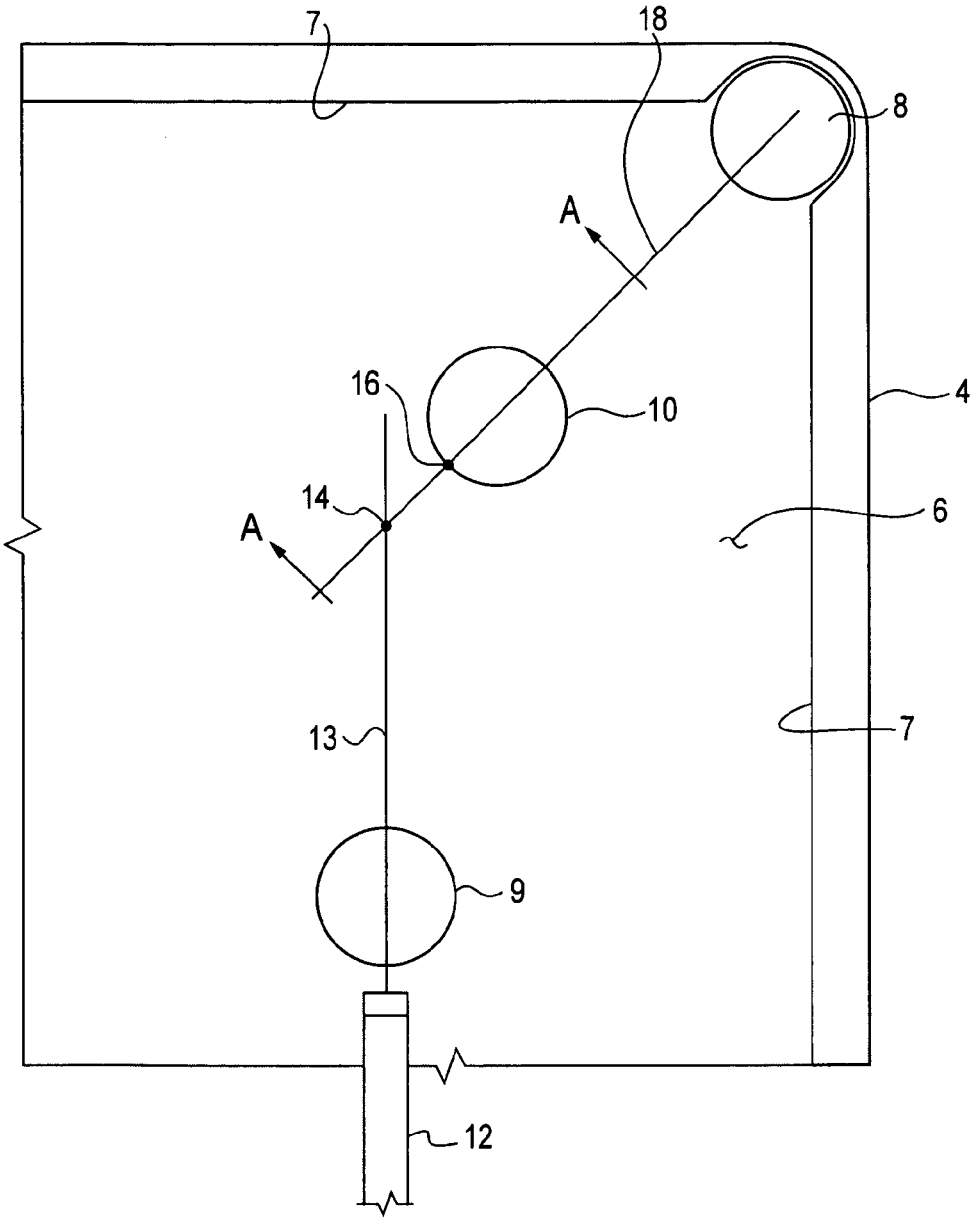
FIG. 1 shows a top view of partial section of a corner of a billiard table.
Figure 2:
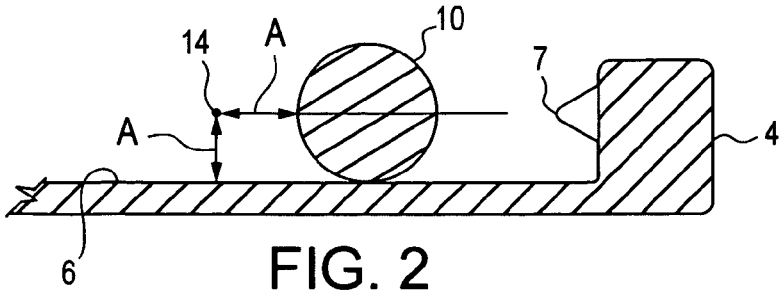
FIG. 2 is a side cross-section view of the table of FIG. 1 taken along lines A-A.

The details of the 'invention are shown in FIGS. 1 through 20. FIG. 1 is a top view of a partial section of a corner of a billiard table 4 having a top-surface 6, side rails 7 and a corner pocket 8. Depicted on the top surface are a cue ball 9 and an object ball 10. Also shown in partial section is the front portion of a cue stick 12. The well known object of the game is to stroke the cue ball with the cue stick along line 13 which is aimed so as to travel through the true point of aim 14, which can also be referred to as the contact point, strike point, sight point, cue ball aiming point, or desired point of contact. In order for the object ball to be deposited in the corner pocket 8 it must be struck by the cue ball at strike point 14. Strike point 14 is an imaginary point in free space best depicted in FIG. 2. FIG. 2 is a side cross-section view of the table of FIG. 1 taken along lines A-A and shows the table top 6, object ball 10 and side rail 7. The strike point 14 is located above the table top at one-half the diameter of the object ball, denoted as A, and spaced away from the outer surface of the object ball 10 at one-half the diameter of the object ball, also denoted as A. The line of travel 13 of the cue ball must pass through this strike point in order for the cue ball to strike the object ball and drive the object ball along the intended path 18. The intended path of the object ball can be either a pocket, a side rail, or another billiard ball for an intended combination shot.

Figure 3:
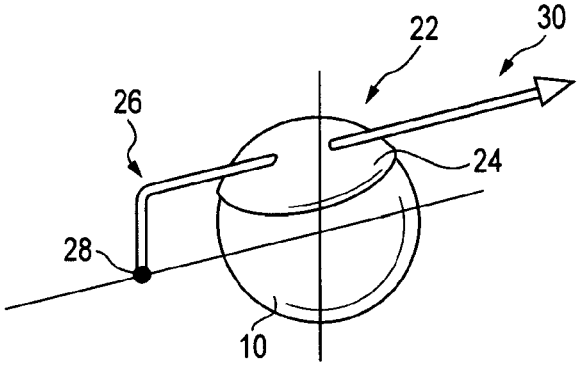
FIG. 3 is a perspective view of a billiard ball with the cue ball aiming device of the present invention.
Figure 3A:
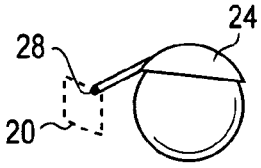
FIG. 3*a* is a first side view of FIG. 3 with the aiming device mounted on the object ball and showing the strike point in the contact zone plane.
Figure 3B:
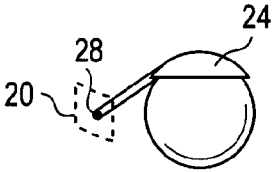
FIG. 3*b* is a second side view of the aiming device mounted on an object ball showing the strike point in a zone of contact.
Figure 3C:
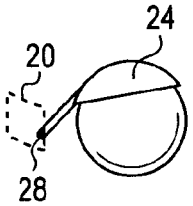
FIG. 3*c* is a third side view of the aiming device mounted on an object ball showing the strike point in a zone of contact.

The cue ball aiming device 22 of the present invention is depicted in perspective view in FIG. 3, and provides the player with a clear and unobstructed view of the aim point to make a shot. The aiming device comprises a support means such as a support section or base structure 24 which contacts and rests on top of the object ball 10, a first means such as a strike point indicator section 26 which operates at a first position with the support 24, and a second means such as a direction indicator section 30 operating at a second position with the support. The support, strike point indicator 24 and direction indicator 30 can take many configurations some of which will be described other figures. The support, the strike point indicator, and the direction indicator can be made integral as for example being molded as a one piece structure, or they can be made of separate pieces and joined by many well known techniques such as being glued together, or having respective snap structure so they can be snapped together. The strike point indicator has defined at one end a strike point 28. The player positions the support 24 on top of the object ball as shown. The support 24 in its preferred design can be self-centering and stabilizing on the object ball, some variations of these configurations to be discussed later. Positioning of the support by the player on the object ball is not critical. This is depicted in FIGS. 3*a*, 3*b*, and 3*c* showing the aiming device in slightly off-center positions from the top center area on the surface of the object ball. It is has been found that even if the support 24 is slightly off center of the object ball top center, the aiming point 28 will be positioned in close proximity to the true point of aim 14 and fall within a contact zone plane 20 to visually define strike point 14 to the player. Depending on how close the object ball is to the final position the player intends the object ball to arrive at, the path of the object ball can vary slightly, to a greater or lesser extent, and still generally arrive at the intended spot on the table. The contact zone plane 20 is essentially a curvilinear plane shown in dotted lines, and depicts the general area of the aim point 14 through which the cue ball must travel in order for the object ball to be driven in the desired intended direction. With the present invention, the strike point 28 is easily positioned at the aim point 14, the true point through which the center of the cue ball must be directed, and therefore the physical location of the strike point 28 assists the player in visualizing the true point of aim.

Figure 4:
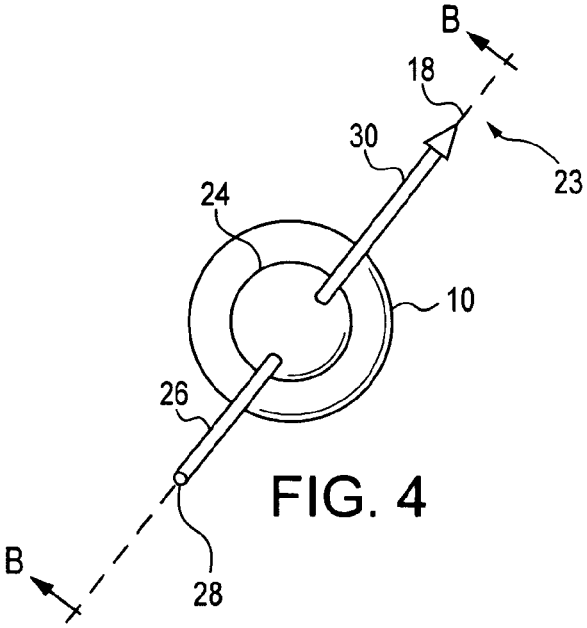
FIG. 4 is a top view of FIG. 3 showing the aiming device mount on an object ball and the strike point.

FIG. 4 is a top view of FIG. 3 and shows how the direction indicator 30 is oriented in the intended direction 18 as indicated by the arrow on indicator 30. After the player positions the aiming device 22 generally on the top area or surface of the object ball, the player orients the direction indicator 30 in the direction of the desired intended path of the object ball. It can be seen that the direction indicator 30 is essentially 180 degrees in the opposite direction from the aiming point 28. The direction indicator 30 and strike point 28 being oriented essentially along the same centerline 23 of the object ball as viewed from the top view. This centerline as shown is also the intended path 18 of the object ball. When the direction indicator is oriented to the intended path, the strike point indicator section 26 simultaneously moves to position the strike or aim point 28 at the true aim point 14. With this aiming device, the aiming device will always position the strike point 28 at the true aim point 14. When object ball is struck by the cue ball at strike point 28 in the contact zone 20, the object ball will be driven in the desired intended path.

It is also noted that the present invention can be used for a combination shot. In a combination shot, well known in billiard play, the cue ball is directed to a first object ball which is directed along a path to a second object ball which has an intended path for example to a billiard pocket. In this instance, a first aiming device according to this invention is positioned on top of the second object ball with the direction indicator oriented to the intended billiard pocket. A second aiming device according to this invention is positioned on top of the first object ball and oriented along an intended path to the strike point defined by the first aiming device. In this way multiple aiming devices can be used to teach a player how to properly visualize multiple strike points for a successful combination shot. Accordingly, more than two aiming devices will be used for combination shots involving more than two object balls.

Figure 5:
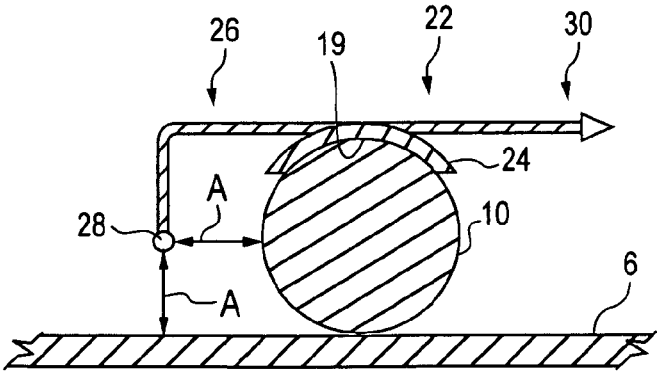
FIG. 5 is a side cross-section view taken along lines B-B of FIG. 4 showing the aiming device mounted on the object ball.

FIG. 5 is a side cross-section view of the object ball 10 of FIG. 4 taken along lines B-B. The cue ball is resting on table top 6, with the cue ball aiming device 22 positioned on the top surface 19 of the object ball. The strike point indicator portion 26 is designed and configured so as to position aiming point 28 at distance A above the table and at a distance A away from the surface of the object ball. In other words the aiming point 28 defines the exact location of strike point 14 as discussed previously in FIG. 2. Since the components of the aiming device are all located on the object ball, the true point of aim is always in view to the player to sight the line of travel 13 of the cue ball.

Figure 6:
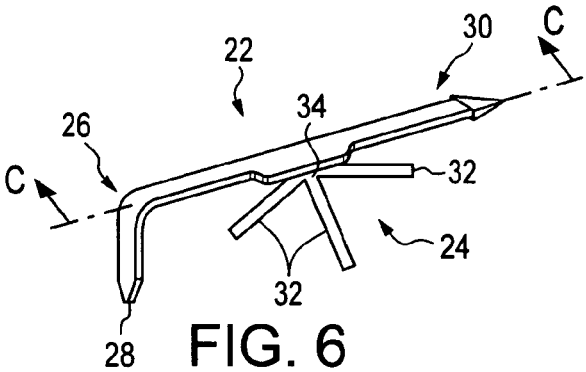
FIG. 6 is a perspective view of a second variation for the cue ball aiming device.
Figure 7:
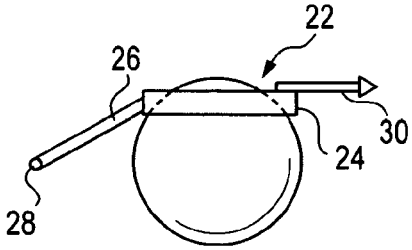
FIG. 7 is a side view of a third variation of the support for the aiming device.
Figure 7A:
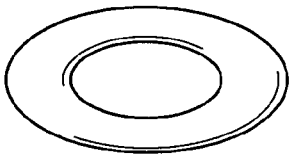
FIG. 7*a* is a perspective view of a fourth variation of the support structure for the aiming device.
Figure 7B:
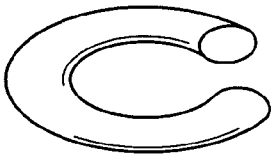
FIG. 7*b* is a perspective view of a fifth variation of the support structure for the aiming device.
Figure 7C:
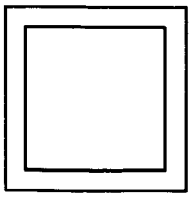
FIG. 7*c* is a perspective view of a sixth variation of the support structure for the aiming device.
Figure 7D:
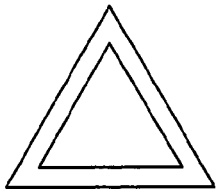
FIG. 7*d* is a perspective view of a seventh variation of the support structure for the aiming device.
Figure 7E:
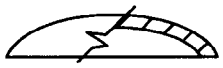
FIG. 7*e* is a perspective view of an eight variation of the support structure for the aiming device.
Figure 7F:
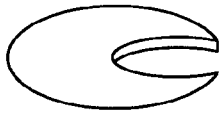
FIG. 7*f* is a perspective view of a ninth variation of the support structure for the aiming device.
Figure 7G:
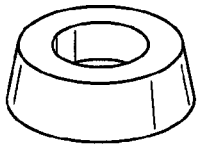
FIG. 7*g* is a perspective view of a tenth variation of the support structure for the aiming device.
Figure 7H:
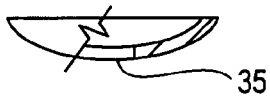
FIG. 7*h* is a perspective view of an eleventh variation of the support structure for the aiming device.
Figure 7K:
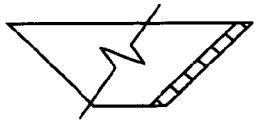
FIG. 7*k* is a perspective view of a twelfth variation of the support structure for the aiming device.

FIG. 6 shows a different configuration for the support section or base structure 24. FIG. 6 shows the support as being made of three equally spaced legs 32 that can be joined at junction 34 by many well known techniques including being injection molded as an integral unitary structure. The strike point indicator 26 and direction indicator 30 (which in this variation has an end point defined as an arrow) can be connected similarly to the support at the junction 34. FIG. 7 is a side view of the cue ball aiming device 22 depicting a support 24 that can take anyone of many configurations, a few examples of the variations shown in FIGS. 7*a* through 7*k*. FIG. 7*a* shows a top view of what the support 24 in FIG. 7 could be and depicts a circular torus shaped support. FIG. 7*b* shows a top view of the support 24 as a partial torus. FIG. 7*c* shows a top view of the support 24 of FIG. 7, in the shape of a square. FIG. 7*d* shows a top view of the support 24 as triangular in shape. FIG. 7*e* shows a side, partially cross-sectioned view of a support similar to the support shown in FIG. 3, with the support being essentially a hollow concave shape. FIG. 7*f* shows a support that is a partial concave shape. FIG. 7*g* shows a support that is frustum of cone shape. FIG. 7*h* shows a support, partially cross-sectioned, that is essentially a hollow convex shape with a hole 35 in the center that can engage the top surface of the object ball 10. FIG. 7*k* shows a support, partially cross-sectioned, as an inverted frustum of a cone shape. The support 24 clearly can take on many more shapes not shown and not depart from the scope and spirit of the invention. All of the configurations can be positioned to rest generally on the top surface portion of the object ball in a stable position at the top of the object ball. Once positioned, the cue ball aiming device 22 is designed to stay in place on the object ball until the object ball is hit by the cue ball.

The support 24, strike point indicator and direction indicator can be designed very light weight and durable and accordingly can be made of plastic, an elastomeric material, paper, wood, rubber, metal, or any hard or soft material that can structurally maintain its shape after being knocked off the object ball hundreds of times.

Figure 8A:
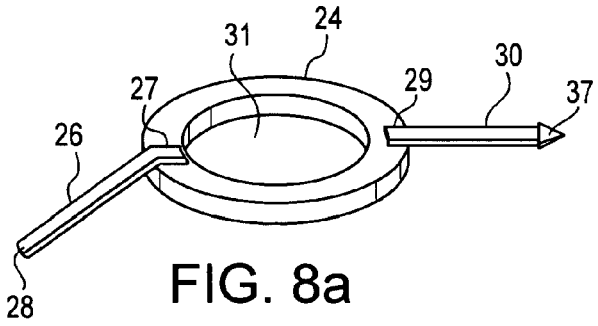
FIG. 8*a* is a perspective view of the aiming device showing a second variation of a strike point indicator section.
Figure 8B:
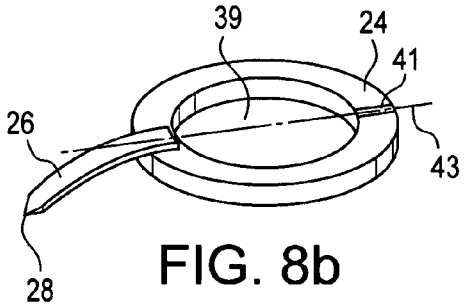
FIG. 8*b* is a perspective view of the aiming device showing a third variation of a strike point indicator structure.

The strike point structure 26 likewise can take on many configurations. The L-shape shown in FIG. 5 is one example for the strike point structure. FIG. 8*a* shows a perspective view of a support section 24 in the form of a flat circular ring having an opening 31 in the center with the strike point indicator 26 defined at a first position 27 on the support, and extending from the support at an angle to aiming point 28. In the opposite direction a direction indicator section 30 in the form of a straight member is mounted on and defined at a second position 29 on the support and has at its end defined thereon an arrow 37. FIG. 8*b* depicts a support 24 again as a flat circular ring with an opening 39, but in this instance the strike point indicator 26 is in the form of a curved member with its end point defining the aiming point 28. In the opposite direction the direction indicator is defined by indicia 41 on the support which can take on many forms such as a groove, a raised ridge portion or simply a mark which can take on many forms such as a light reflecting surface or paint, or a fluorescent coating. The indicia 41 and indicator 26 lie along straight line 43, the intended path of the object ball. The strike point indicator 26 and direction indicator 41 can be made of similar or dissimilar materials as before described for support 24.

Figure 10:
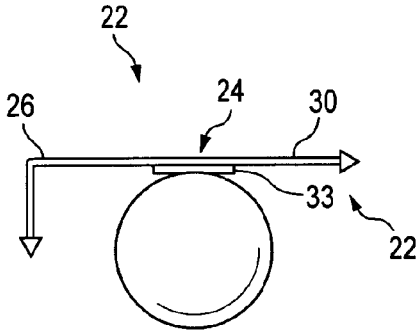
FIG. 10 is a side view of another variation of the aiming device.
Figure 9:
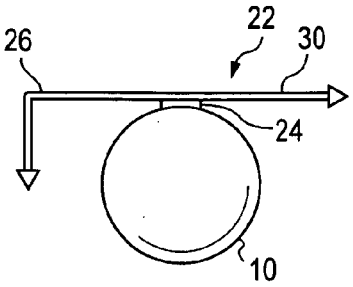
FIG. 9 is a side view of another variation of the aiming device.

Also contemplated are other forms for the support section adapted to rest on or engage the object ball as shown in FIGS. 9 and 10. FIG. 9 shows a weighted support 24 for resting on the top central area of the object ball. The support has the strike point indicator section 26 and direction indicator section 30 designed so as to permit balancing the aiming device 22 on top of the object ball 10. A variation of this is shown in FIG. 10 where the support section 24, strike indicator section 26 and direction indicator section 30 are made as a unitary or integral structure. In this instance the integral aiming device structure 22 can be a flat member with an angle at one end to define the strike point 28. This integral structure could, for example be a flat sheet of plastic, a wire frame, metal bent at one end or injection molded to form a unitary structure. A thin layer of rubber, sticky or tacky material 33 is located under the aiming device at its balance point. The player simply positions the aiming device 22 on the object ball and the contact force of the tacky material with the top of the object ball will keep the aiming device positioned on top of the object ball until knocked off the object ball by the cue ball.

Figure 11:
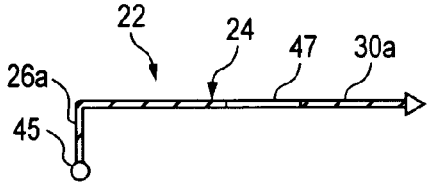
FIG. 11 is a side cross-section view taken along lines C-C of FIG. 6 showing the strike point as a sphere.
Figure 12:
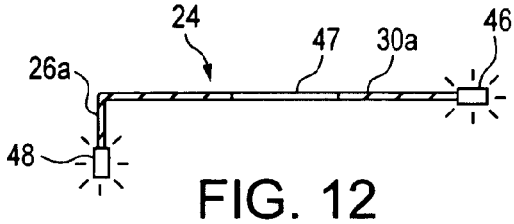
FIG. 12 is a side cross-section view taken along line C-C showing the strike point as a fluorescent light source.
Figure 13:
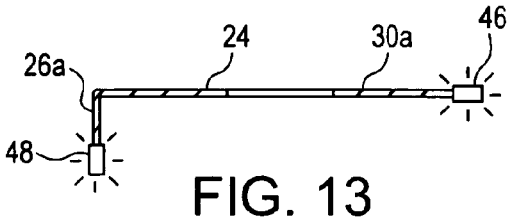
FIG. 13 is a side cross-section view taken along lines C-C showing the strike point as a light source.
Figure 20:
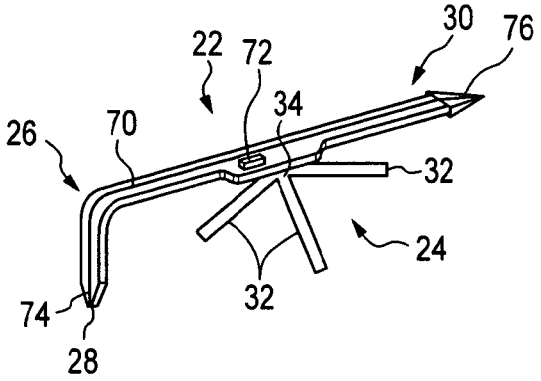
FIG. 20 is second variation of the aiming device of FIG. 6 showing the use of a fiber optic light guide on the aiming device.

FIGS. 11, 12 and 13 are side cross-sections taken along lines C-C of strike point section 28 and the direction indicator section 30 of FIG. 6 excluding the support 24. The aiming device 22, depicted by support section 24, strike point indicator section, and direction indicator section is shown as a one piece flat structure or for example can be made from a wire form. A single piece of wire or other material is bent into the shape and form of the structure shown in these figures. The support section 24 in these variations shows an area centrally located defining an opening 47 for positioning the aiming device on the top surface of the object ball. The strike point indicator section is at a first end location 26*a* and the direction indicator section is at a second end location 30*a*. In one form the strike end point 45 can simply be spherical in shape as shown in FIG. 11. In another variation the strike point 48 and the direction indicator 46 can take the form of a light reflecting surface or fluorescent surface, coating or material as shown in FIG. 12. Or the strike point 48 and end point 46 of the direction indicator can be a source of light as in FIG. 13, one example being a light emitting diode. The light emitting diode can take on many configurations such as a sphere, square, triangle, rectangle, or other forms. A light source makes the aiming point and direction indicator even easier for the player see and to visualize the true point of aim for the cue ball. In addition, to provide further contrast of the light source in the surroundings of the billiard table, the light source can be made to pulse on and off. Another variation of the aiming device is for a light guide in the form of a fiber optic light guide to be mounted on the support, strike indicator and direction indicator as best depicted in FIG. 20. In that instance, a light source (as a light emitting diode or micro laser) can also be located on the support to inject light into the guide so that light exists at locations 46 and 48. If a light source is used a source of electrical power is necessary and variations are shown in FIGS. 14 and 15.

Figure 14:
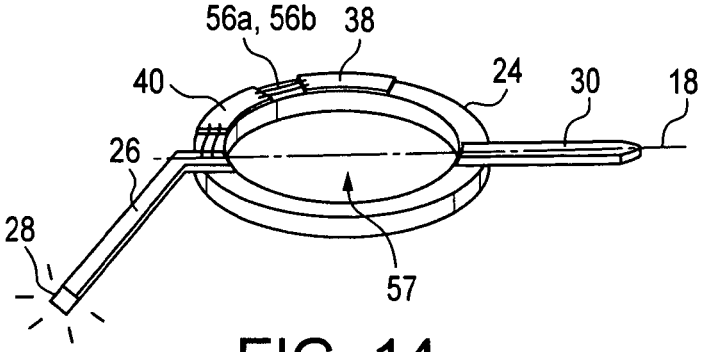
FIG. 14 is a perspective view of the aiming device showing the location of the electrical source on the support.
Figure 15:
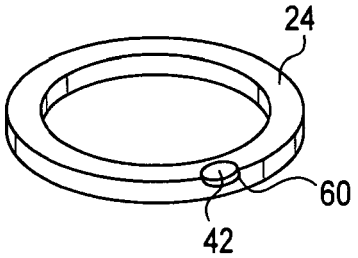
FIG. 15 is a perspective view of the aiming device showing the electric source as a battery.
Figure 16:
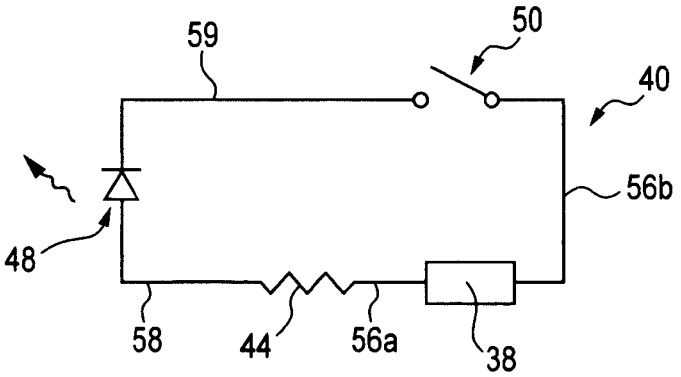
FIG. 16 is an electrical schematic for powering the light source.

FIG. 14 is a perspective view of support 24 in the form of a section of a cylinder. The center opening 57 centers and stabilizes the support on the object ball. Mounted on top of the support is an electrical energy source 38 which can take as example, the form of either a solar cell or battery. The source of electricity is connected by electrical leads 56*a* and 56*b* to an electric circuit 40, shown in FIG. 16. The electric circuit components comprise the energy source 38, a current limiting resistor 44 connected by leads 58 to light source 48 (which in this instance shows a light emitting diode). The light emitting diode is connected by lead 59 to switch 50. The switch is optional with the use of a solar cell. When a solar cell is used the circuit can be in the constant on position. The circuit components are connected as shown by respective electrical leads well known in the art. FIG. 15 shows a support 24 having a battery 42 mounted thereon as in a slot 60. If a battery is used, then in this instance an on-off switch 50 may be necessary. A solar cell is preferred a source of electricity since is does not have to be replaced, is light in weight and generally smaller in size.

Figure 17:
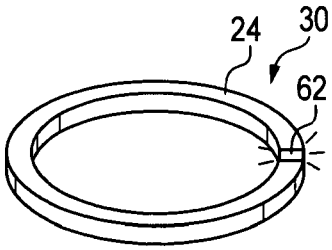
FIG. 17 is a perspective view of the aiming device support structure showing the use of indicia on the direction indicator section.

FIG. 17 shows a further structural variation of the direction indicator 30. The direction indicator 30 is shown as indicia 62 on the support which could also take the form of a light reflecting surface, a fluorescent coating or material, or a light source (as in a light emitting diode) powered by the electric circuit 40.

Figure 18:
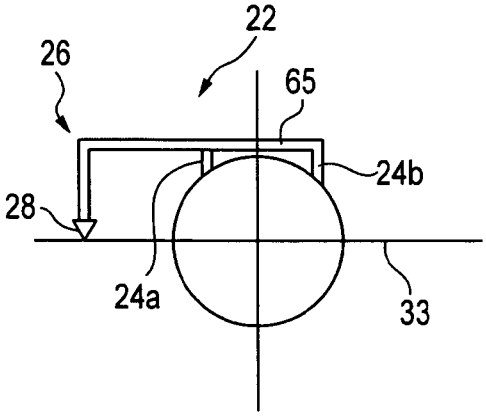
FIG. 18 is a side view depicting a further variation of the support structure.
Figure 18A:
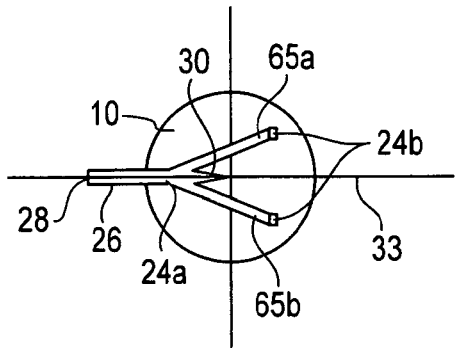
FIG. 18*a* is a top view of FIG. 18.

FIG. 18 shows a side view of a further variation of the support structure 24 as being defined by support portion 24*a* and support portions 24*b* connected by top portion 65. Best viewed in FIG. 18*a*, a top view of FIG. 18, the portion 65*a* and portion 65*b* essentially define a triangular support. The strike point indicator 26 and direction indicator 30 in this configuration are essentially on the same side of the object ball 10. Again the strike point 28 and direction indicator 30 lie along a straight line 33 corresponding approximately to a centerline of the object ball 10.

Figure 19:
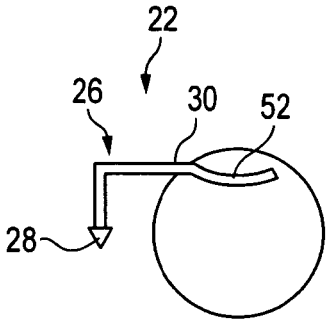
FIG. 19 is a side view of a further variation of the support structure.
Figure 19A:
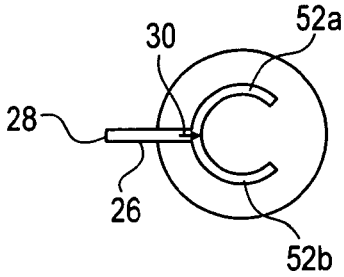
FIG. 19*a* is a top view of FIG. 19.

FIG. 19 shows a side view of further variation of the support structure 52 as being defined by arms 52*a* and 52*b* integrally connected to strike point indicator 26 best viewed in FIG. 19*a*. FIG. 19*a* a top view of FIG. 19. End portions 52*a* and 52*b* can be weighted to counterbalance the strike point indicator arm 26. This is another example of the strike point indicator 26 and direction indicator 30 being essentially on the same side of the object ball 10. Here the direction indicator 30 is located in close proximity to the strike point indicator 26 and will provide the desired result of being able to orient the direction indicator along the intended path for the object ball. Likewise, it is contemplated that the strike point indicator can be positioned in close proximity to the direction indicator on the opposite side of the object ball and still configured to properly position the point of aim with respect to the object ball. FIG. 20 is essentially FIG. 6 with a fiber optic light guide 70 located on the top surface of aiming device 22. A light source 72 is mounted near the light guide to inject light into the light guide. The random light from the light source will be injected into the guide and be reflected along the length of the guide in both the strike point indicator section and the direction indicator section. In this way a point of light will exit the light guide at 74 to define the strike point and light will also exit at 76 to direct a beam of light in the intended path of travel for the object ball as selected by the player.

These and many other variations in the construction and application of the invention will suggest themselves to those skilled in the art to which the present invention pertains. And while the present invention had been described with reference to particular embodiments and preferred embodiments and the accompanying drawings, it will be understood by those skilled in the art that the invention is not limited to the preferred embodiment and that there are many other variations and modifications possible without departing from the scope and spirit of the invention as defined in the following claims.

What is claimed is:

1. An object ball spotter for aiming a cue ball to an object ball to a desired direction on a billiard table, comprising:

a support which contacts and is supported on a top area of the object ball;

a strike point indicator defined on the support at a first position, the strike point indicator defining a strike point for the cue ball; and a direction indicator defined on the support at a second position indicating the desired direction of the object ball, whereby upon orienting the direction indicator to the desired direction the strike point indicator defines the location of the strike point for the cue ball.

2. An object ball spotter according to claim 1 wherein the support has a configuration that can rest on the top area of the object ball and maintain the object ball spotter on the object ball.

3. An object ball spotter according to claim 2 wherein the configuration is in the form of a torus.

4. An object ball spotter according to claim 2 wherein the configuration is a flat surface with a hole to self-center the support on the object ball.

5. An object ball spotter according to claim 1 wherein the support, strike point indicator pointer and direction indicator are an integral structure.

6. An object ball spotter according to claim 1 wherein the support, the strike point indicator and direction indicator are made as separate pieces, the strike point indicator and direction indicator each having respective connection structure to connect to the support.

7. An object ball spotter according to claim 6 wherein the connection structure is a snap connection.

8. An object ball spotter according to claim 1 wherein the strike point indicator has the strike point in the shape of an arrow.

9. An object ball spotter according to claim 1 further having mounted on the support a source of electrical energy.

10. An object ball spotter according to claim 9 wherein the source of electrical energy is a solar cell.

11. An object ball spotter according to claim 9 wherein the source of electrical energy is a battery.

12. An object ball spotter according to claim 1 wherein the strike point is a source of light.

13. An object ball spotter according to claim 12 wherein the source of light is a pulsing source of light.

14. An object ball spotter according to claim 12 wherein the source of light is a light emitting diode.

15. An object ball spotter according to claim 12 wherein the source of light is a light reflecting surface.

16. An object ball spotter according to claim 12 wherein the source of light is a florescent surface.

17. An object ball spotter according to claim 12 wherein the source of light is a florescent material.

18. An object ball spotter according to claim 1 wherein the direction indicator is a structure extending away from the support.

19. An object ball spotter according to claim 1 wherein the direction indicator is indicia located on the support.

20. A cue ball spotter for an object ball in a billiard game, comprising:

a support structure which contacts and rests on a top surface of the object ball;

a sight point indicator on the support structure at a first position, the sight point indicator defining a desired cue ball strike point; and a direction indicator located on the support structure at a second position for indicating a desired intended path of travel for the object ball and for positioning the sight point indicator to the desired cue ball strike point.

21. A cue ball spotter according to claim 20 wherein the support structure has a shape that is self-centering on the top surface of the object ball.

22. A cue ball spotter according to claim 21 wherein the shape is in the form of a torus.

23. A cue ball spotter according to claim 20 wherein the support structure, sight point indicator and direction indicator are an integral structure.

24. A cue ball spotter according to claim 20 wherein the support structure, sight point indicator and direction indicator are made as separate pieces, the sight point indicator and direction indicator each having respective connection structure to connect to the base structure.

25. A cue ball spotter according to claim 20 further having mounted on the support structure a source of electrical energy.

26. A cue ball spotter according to claim 25 wherein the source of electrical energy is a solar cell.

27. A cue ball spotter according to claim 20 wherein the cue ball strike point is a source of light.

28. A cue ball spotter according to claim 27 wherein the source of light is a light emitting diode.

29. A cue ball spotter according to claim 20 wherein the direction indicator is indicia located on the support structure.

30. A cue ball spotter according to claim 20 further including a fiber optic light guide positioned on the cue ball spotter and extending from the cue ball strike point along the cue ball spotter to the direction indicator.

31. A cue ball spotter according to claim 30 further including a light source positioned near the fiber optic light guide to inject light into the fiber optic light guide.

32. A cue ball aiming device for aiming a cue ball with respect to an object ball, comprising:

a support which contacts and rests on a top surface of the object ball;

a cue ball strike point structure defined on the support at a first position; and indicia located on the support at a second position capable of being oriented to a desired intended direction of travel for the object ball and for positioning the cue ball strike point with respect to the object ball.

33. A cue ball aiming device according to claim 32 wherein the support has a shape that is self-centering on the object ball.

34. A cue ball aiming device according to claim 32 wherein the support, cue ball strike point and indicia are an integral structure.

35. A cue ball aiming device according to claim 32 further having mounted either on the support, on the cue ball strike point structure, or on the indicia a source of electrical energy.

36. A cue ball aiming device according to claim 35 wherein the source of electrical energy is a solar cell.

37. A cue ball aiming device according to claim 32 wherein the cue ball strike point is a source of light.

38. A cue ball aiming device according to claim 37 wherein the source of light is a light emitting diode.

39. A device for teaching aiming of a cue ball to an object ball in a billiard game, comprising:

a support which contacts and rests upon a top area of the object ball;

a sight point indicator on the support at a first position, the sight point indicator defining a desired cue ball strike point; and a direction indicator located on the support at a second position for indicating the desired intended direction of travel for the object ball and for positioning the sight point indicator to the desired cue ball strike point.

40. A device for teaching aiming of a cue ball to an object ball as recited in claim 39 further having mounted on the support a source of electrical energy.

41. A device for teaching aiming of a cue ball to an object ball as recited in claim 40 wherein the source of electrical energy is a solar cell.

42. A device for teaching aiming of a cue ball to an object ball as recited in claim 39 wherein the cue ball strike point is a source of light.

43. A device for teaching aiming of a cue ball to an object ball as recited in claim 42 wherein the source of light is a light emitting diode.

44. A device for teaching aiming of a cue ball to an object ball as recited in claim 42 wherein the source of light is a light reflecting surface.

45. A device for teaching aiming of a cue ball to an object ball as recited in claim 42 wherein the source of light is a florescent surface.

46. In a billiard game training device for teaching a player a point of contact of aim for a cue ball with an object ball, comprising:

a support which contacts and rests upon a top surface of the object ball;

a cue ball point of aim indicator defined at a first position on the support, the cue point of aim indicator defining a point of aim with respect to the object ball; and indicia defined on the support at a second position capable of being oriented to a desired intended direction of travel for the object ball and for positioning the cue ball point of aim indicator to the cue ball point of aim.

47. A point of aim indicator for defining a strike point for a cue ball at an object ball on a billiard table, comprising:

a means for supporting which contacts and rests upon a top surface of the object ball;

a first means for defining a strike point with respect to the object ball, the first means mounted on the support at a first position; and a second means for indicating the desired direction of travel for the object ball and positioning the first means with respect to the object ball, the second means mounted on the means for supporting at a second position, whereby upon striking the cue ball to the strike point the object ball will be pushed to-travel in the desired direction of travel on the billiard table.

48. A billiard ball training device for defining a desired point of aim for a cue ball to strike a billiard ball, comprising:

a support which contacts and rests upon a top surface of the billiard ball;

a point of aim indicator on the support indicating the desired point of aim; and a direction indicator on the support for indicating a desired intended direction of travel for the billiard ball, the direction indicator positioning the point of aim indicator at the desired point of aim.

49. A cue ball aiming device, comprising:

a support structure;

a strike point indicator structure attached to the support structure;

the strike point indicator structure including first and second sections;

a direction indicator structure attached to the support structure;

a strike point on the second section of the strike point indicator structure;

the first section of the strike point indicator section and the direction indicator section being collinear;

wherein, when the support structure rests on a surface of an object ball which is to be struck by a cue ball, the object ball having a radius, the strike point is positioned a distance approximately equal to the radius above a playing surface upon which rests both the cue ball and the object ball, and the strike point is simultaneously positioned a distance approximately equal to the radius away from the object ball.

50. A device according to claim 49, wherein the strike point indicator structure and the direction indicator structure are on opposite sides of the support structure.

51. A device according to claim 49, wherein the strike point indicator structure and the direction indicator structure are on a same side of the support structure.

* * * * *